US010895352B1

(12) United States Patent
Lu et al.

(10) Patent No.: US 10,895,352 B1
(45) Date of Patent: Jan. 19, 2021

(54) LED TUBE CAPABLE OF BEING SUPPLIED WITH ELECTRICITY BY ELECTRICAL BALLAST AND MAINS SUPPLY

(71) Applicant: Xiamen PVTECH Co., Ltd., Fujian (CN)

(72) Inventors: Fuxing Lu, Fujian (CN); Rongtu Liu, Fujian (CN)

(73) Assignee: Xiamen PVTECH Co., Ltd., Fujian (CN)

( * ) Notice: Subject to any disclaimer, the term of this patent is extended or adjusted under 35 U.S.C. 154(b) by 0 days.

(21) Appl. No.: 16/856,047

(22) Filed: Apr. 23, 2020

(30) Foreign Application Priority Data

Oct. 31, 2019 (CN) ..... 2019 1 1063118

(51) Int. Cl.

| | |
|---|---|
| ***F21K 9/278*** | (2016.01) |
| ***F21K 9/66*** | (2016.01) |
| ***F21K 9/272*** | (2016.01) |
| ***F21V 25/10*** | (2006.01) |
| ***H05B 45/38*** | (2020.01) |
| ***F21V 23/06*** | (2006.01) |
| ***H05B 45/375*** | (2020.01) |
| *F21Y 115/10* | (2016.01) |
| *F21Y 103/10* | (2016.01) |

(52) U.S. Cl.
CPC ..... *F21K 9/278* (2016.08); *F21K 9/272* (2016.08); *F21K 9/66* (2016.08); *F21V 23/06* (2013.01); *F21V 25/10* (2013.01); *H05B 45/375* (2020.01); *H05B 45/38* (2020.01); *F21Y 2103/10* (2016.08); *F21Y 2115/10* (2016.08)

(58) Field of Classification Search
CPC . F21K 9/66; F21K 9/272; F21K 9/278; F21V 23/06; F21V 23/10; H05B 45/38; H05B 45/375
See application file for complete search history.

(56) References Cited

U.S. PATENT DOCUMENTS

| | | | | |
|---|---|---|---|---|
| 10,349,474 | B2 * | 7/2019 | Lu | H05B 45/37 |
| 2014/0265900 | A1 * | 9/2014 | Sadwick | H05B 45/00 315/200 R |

* cited by examiner

*Primary Examiner* — Alexander H Taningco
*Assistant Examiner* — Pedro C Fernandez
(74) *Attorney, Agent, or Firm* — Winston Hsu

(57) ABSTRACT

An LED tube is provided. Two ends of the LED tube respectively have two conductive pin assemblies electrically connected to the mains supply and a detecting control component in the LED tube and electrically connected to an electrical ballast. A voltage conversion device perform an AC-DC voltage conversion. A recognizable electrical ballast detects a voltage state of the voltage conversion device to recognize a voltage impedance complying with the electrical ballast or the mains supply, thereby generating a feedback signal. A signal receiving module of the voltage impedance signal-recognizing device obtains the feedback signal, and the signal executing module of the voltage impedance signal-recognizing device generates a DC starting voltage complying with the electrical ballast or the mains supply. The DC starting voltage is filtered by the DC filtering module, and an outputted current magnitude of the DC starting voltage is adjusted by the buck-boost constant current module.

8 Claims, 4 Drawing Sheets

LED TUBE CAPABLE OF BEING SUPPLIED WITH ELECTRICITY BY ELECTRICAL BALLAST AND MAINS SUPPLY

BACKGROUND OF THE INVENTION

1. Field of the Invention

The present invention relates to an LED tube, in particular to an LED tube capable of being supplied with electricity by electrical ballast and mains supply.

2. Description of the Prior Art

In recent years, along with trends of energy saving and carbon emission reduction, LED light sources are widely applied in markets with different applications. The LED lighting provides an innovative lighting device efficiently reducing the energy consumption. Thus, the LED lighting is widely applied to areas with electricity shortage, and the LED lighting is also widely used in global markets.

Existing fluorescent lamp device mainly includes a base, a fluorescent lamp tube, and an electrical ballast. If the fluorescent lamp tube is replaced by an LED tube to reduce the electricity consumption, an LED tube compatible with the specification of the electrical ballast is to be provided, or the entire lamp base is to be replaced. Any of the foregoing treatments for the adoption of the LED tube are time consuming and costive.

Therefore, how to adopt the issues to allow a single LED tube to be complying with the existing electrical ballast and to be compatible with the manner of supplying electricity by the mains supply is to be considered.

SUMMARY OF THE INVENTION

In view of these, an LED tube capable of being supplied with electricity by an electrical ballast and mains supply is provided. Two ends of the LED tube respectively have two conductive pin assemblies electrically connected to the mains supply and a detecting control component in the LED tube and electrically connected to the electrical ballast. Each of the conductive pin assemblies comprises two pins. The detecting control component further comprises a voltage conversion device, a recognizable electrical ballast, a voltage impedance signal-recognizing device, a direct current filtering module, and a buck-boost constant current module. The voltage impedance signal-recognizing device comprises a signal receiving module and a signal executing module. The voltage conversion device is electrically connected to the electrical ballast or the mains supply to perform an alternate current-direct current (AC-DC) voltage conversion. The recognizable electrical ballast is electrically connected to the voltage conversion device to detect a voltage state of the voltage conversion device to recognize a voltage impedance complying with the electrical ballast or the mains supply, so that the recognizable electrical ballast generates a feedback signal. The signal receiving module of the voltage impedance signal-recognizing device obtains the feedback signal, and the signal executing module automatically encloses to form a loop, thereby generating a direct current starting voltage complying with the electrical ballast or the mains supply. The direct current starting voltage is filtered by the direct current filtering module, and an outputted current magnitude of the direct current starting voltage is adjusted by the buck-boost constant current module.

In some embodiments, the electrical ballast is further electrically connected to a first buck circuit module and a second buck circuit module.

In some embodiments, the first buck circuit module is formed by a plurality of capacitors.

In some embodiments, the second buck circuit module comprises at least one varistor or at least one transient suppression diode.

In some embodiments, the voltage conversion device is a bridge rectifier.

In some embodiments, each of the conductive pin assemblies is connected to a fuse.

In some embodiments, the fuse is a current-limiting fuse, a temperature-limiting fuse, or a self-recoverable fuse.

In some embodiments, the LED tube further comprises a base and a lampshade. The base is provided for assembling with the conductive pin assemblies, the detecting control component, and an LED component. The lampshade is assembled on the base and shields the LED component.

Based on the above, according to one or more embodiments, the LED tube have following features. By using the voltage impedance signal-recognizing device of the detecting control component, the voltage of the electricity inputted by the mains supply or the voltage of the electricity inputted by the electrical ballast can be recognized, thereby simplifying the driving circuit, reducing the space occupied by the circuit board, and reducing the costs of the LED tube. Moreover, an anti-leakage test can be performed, thereby preventing the user from unintentionally touching the electricity leakage portion of the LED to cause electrical shock.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
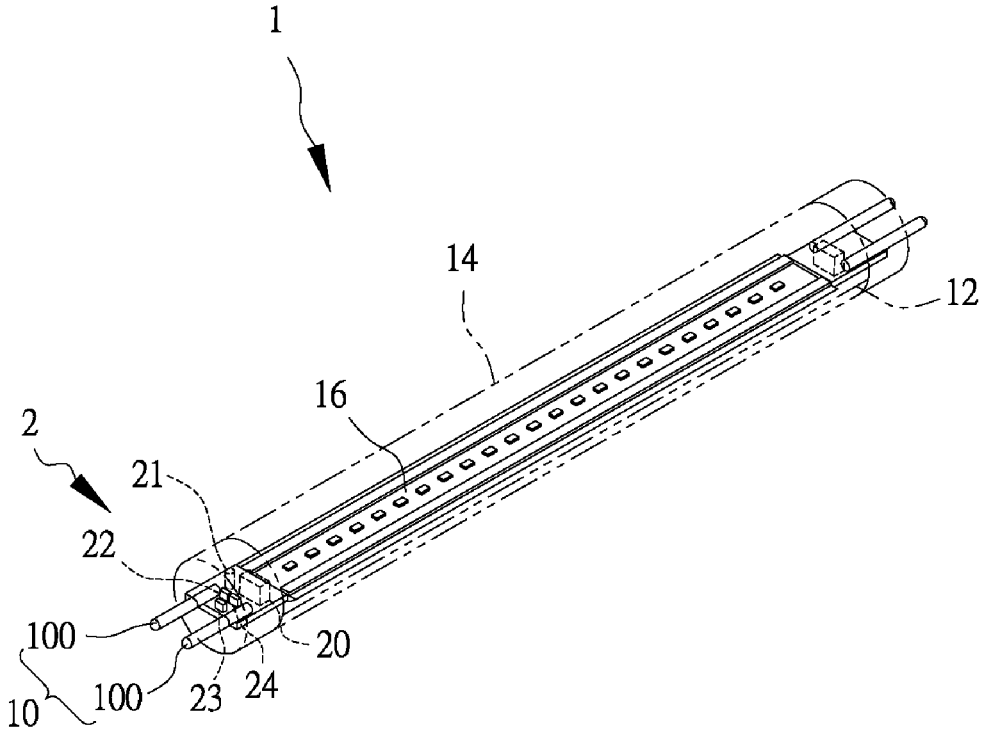
FIG. 1 illustrates a perspective view of an LED tube according to an exemplary embodiment of the present invention.

The detailed features and the advantages of the present invention will become more obvious from the following description for any person having ordinary skills in the art to carry out the claimed invention. Further, based on the disclosure, the claims, and the accompanying drawings, any person having ordinary skills in the art can understand the purpose and the advantages of the present invention easily.

The detailed description of the technical content, structural features, and the objects and effects of the technical solutions will be described in detail below with reference to the specific embodiments and the accompanying drawings.

By using the voltage impedance signal-recognizing device of the detecting control component, the voltage of the electricity inputted by the mains supply or the voltage of the electricity inputted by the electrical ballast can be recognized, thereby simplifying the driving circuit, reducing the space occupied by the circuit board, and reducing the costs of the LED tube. Moreover, an anti-leakage test can be performed, thereby preventing the user from unintentionally touching the electricity leakage portion of the LED to cause electrical shock. Please refer to FIGS. 1 to 4, respectively illustrating a perspective view of an LED tube according to an exemplary embodiment of the present invention, a circuit block diagram of an LED tube according to a first embodiment of the present invention, a circuit block diagram of an LED tube according to a second embodiment of the present invention, and a circuit block diagram of an LED tube according to a third embodiment of the present invention.

In one embodiment, an LED tube capable of being supplied with electricity by an electrical ballast and mains supply (hereinafter, LED tube 1) is provided. Two ends of the LED tube 1 respectively have two conductive pin assemblies 10 electrically connected to the mains supply 4 and a detecting control component 2 in the LED tube 1 and electrically connected to the electrical ballast 3. Each of the conductive pin assemblies 10 comprises two pins 100. The detecting control component 2 further comprises a voltage conversion device 20, a recognizable electrical ballast 21, a voltage impedance signal-recognizing device 22, a direct current filtering module 23, and a buck-boost constant current module 24. The voltage impedance signal-recognizing device 22 comprises a signal receiving module 220 and a signal executing module 222. The voltage conversion device 20 (a bridge rectifier) is electrically connected to the electrical ballast 3 or the mains supply 4 to perform an alternate current-direct current (AC-DC) conversion. The recognizable electrical ballast 21 is electrically connected to the voltage conversion device 20 to detect a voltage state of the voltage conversion device 20 to recognize a voltage impedance complying with the electrical ballast 3 or the mains supply 4, so that the recognizable electrical ballast 21 generates a feedback signal. The signal receiving module 220 of the voltage impedance signal-recognizing device 22 obtains the feedback signal, and the signal executing module 222 automatically encloses to form a loop, thereby generating a direct current starting voltage complying with the electrical ballast 3 or the mains supply 4. The direct current starting voltage is filtered by the direct current filtering module 23, and a current magnitude of the direct current starting voltage is adjusted by the buck-boost constant current module 24.

In this embodiment, the electrical ballast 3 is further electrically connected to a first buck circuit module 25 and a second buck circuit module 26. The first buck circuit module 25 is formed by a plurality of capacitors, and the second buck circuit module 26 comprises at least one varistor or at least one transient suppression diode.

In this embodiment, each of the conductive pin assemblies 10 is connected to a fuse 101, and the fuse 101 may be a current-limiting fuse, a temperature-limiting fuse, or a self-recoverable fuse.

In this embodiment, the LED tube 1 further comprises a base 12 and a lampshade 14. The base 12 is provided for assembling with the conductive pin assemblies 10, the detecting control component 2, and an LED component 16. The lampshade 14 is assembled on the base 12 and shields the LED component 16.

Figure 2:
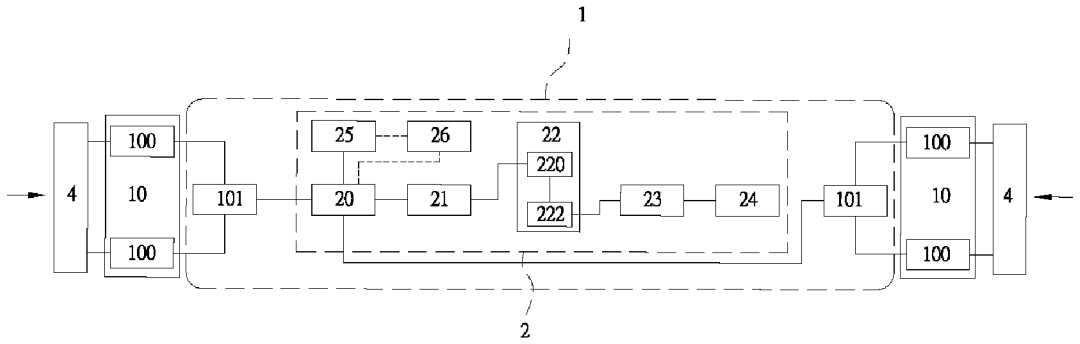
FIG. 2 illustrates a circuit block diagram of an LED tube according to a first embodiment of the present invention.

From FIG. 2, the operation for how the LED tube 1 automatically detects the mains supply 4 can be understood. When the LED tube 1 is assembled, the conductive pin assemblies 10 at the two ends of the LED tube 1 are electrically connected to the mains supply 4, respectively. Hence, the pins 100 of the conductive pin assemblies 10 receive the alternate current (the frequency of the alternate current of the mains supply 4 is 47 Hz to 60 Hz) of the mains supply 4, and the voltage conversion device 20 performs the AC-DC voltage conversion. Next, the recognizable electrical ballast 21 electrically connected to the voltage conversion device 20 is used to detect the voltage state of the direct current. Because the detected direct current voltage has a low frequency and a low voltage, the signal receiving module 20 of the voltage impedance signal-recognizing device 22 receives the direct current with low frequency and low voltage, and the generated feedback signal is the feedback signal of the mains supply 4. Next, the signal executing module 222 generates a direct current starting voltage complying with the mains supply 4. Moreover, the direct current starting voltage is filtered by the direct current filtering module 23, and the current magnitude of the direct current starting voltage outputted to the LED component 16 is adjusted by the buck-boost constant circuit module 24.

Figure 3:
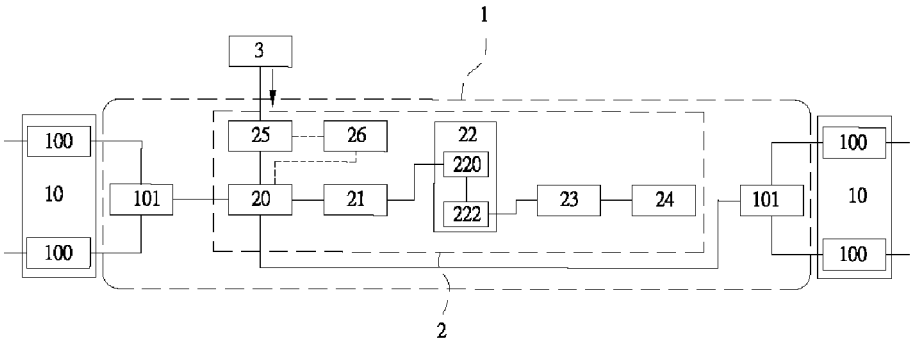
FIG. 3 illustrate a circuit block diagram of an LED tube according to a second embodiment of the present invention.

From FIG. 3, the operation for how the LED tube 1 automatically detects the electrical ballast 3 can be understood. The LED tube 1 is assembled to an existing fluorescent lamp holder, which has an electrical ballast 3 (the frequency of the alternate current of the electrical ballast 3 is 29 KHz to 100 KHz). Because the alternate current of the electrical ballast 3 has a high frequency and a high voltage, the voltage conversion device 20 performs the AD-DC voltage conversion, and then the recognizable electrical ballast 21 electrically connected to the voltage conversion device 20 is used to detect the voltage state of the direct current. Because the detected direct current has a high frequency and high voltage, the signal receiving module 220 of the voltage impedance signal-recognizing device 22 receives the direct current with high frequency and high voltage, and the generated feedback signal is the feedback signal of the electrical ballast 3. Next, the signal executing module 222 automatically encloses to form a loop, thereby generating a direct current starting voltage complying with the electrical ballast 3. Moreover, the direct current starting voltage is filtered by the direct current filtering module 23, and the current magnitude of the direct current starting voltage outputted to the LED component 16 is adjusted by the buck-boost constant circuit module 24.

It is understood that, the first buck circuit module 25 and the second buck circuit module 26 are electrically connected between the electrical ballast 3 and the voltage conversion device 20. The first buck circuit module 25 is formed by a plurality of capacitors, and the second buck circuit module 26 comprises at least one varistor or at least one transient suppression diode. The capacitances of two of the capacitors of the first buck circuit module 25 are in the range from 4.7 nF to 100 nF, and the withstand voltage is greater than 400V DC; the capacitance of the third capacitor of the first buck circuit module 25 is in the range from 0.47 nF to 3.3 nF. The capacitance required by the operation of the LED tube 1 can be continuously outputted by using the first buck circuit module 25. If the current capacitance exceeds the storable amount for the capacitors of the first buck circuit module 25, the second buck circuit module 26 is adapted to process the residual capacitance. The first buck circuit module 25 and the second buck circuit module 26 are mainly provided for suppressing the outputted voltage of the electrical ballast 3, thereby limiting the driving inputted voltage of the electrical ballast 3 in the electricity-supplying condition.

Figure 4:
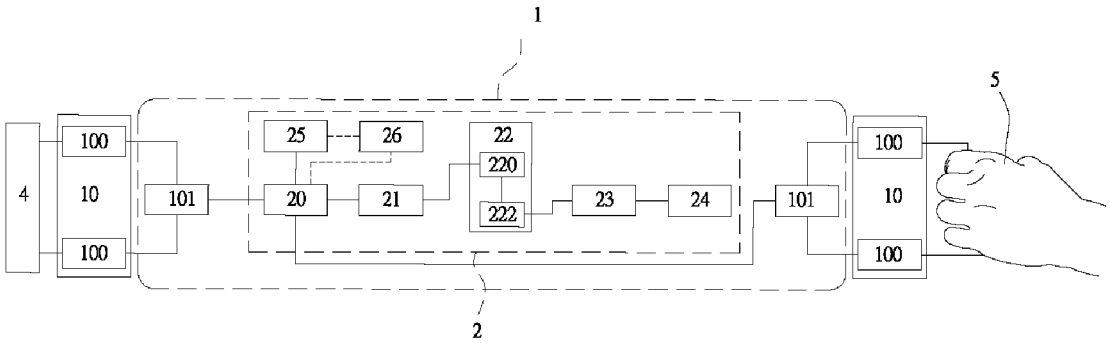
FIG. 4 illustrates a circuit block diagram of an LED tube according to a third embodiment of the present invention.

From FIG. 4, the operation for how to applying an anti-leakage test to the LED tube 1 can be understood. As mentioned above, not only the dual compatibility for both the electricity supplied by the electrical ballast 3 and the electricity supplied by the mains supply 4 to the LED tube 1 is allowed, but also the anti-leakage test to the LED tube 1 can be achieved. When a human's body touches one of the conductive pin assemblies 10, the touching portion of the conductive pin assembly 10 becomes a resistor with a greater resistance. Hence, the signal receiving module 220 of the voltage impedance signal-recognizing device 22 cannot receive any feedback signal with any voltage. Accordingly, the direct current starting voltage generated by the signal executing module 222 is insufficient to start the LED tube 1. Therefore, when a person unintentionally touches the conductive pin assembly 10, the electrical shock issue can be prevented.

Although particular embodiments of the invention have been described in detail for purposes of illustration, various modifications and enhancements may be made without departing from the spirit and scope of the invention. Accordingly, the invention is not to be limited except as by the appended claims.

What is claimed is:

1. An LED tube capable of being supplied with electricity by an electrical ballast and mains supply, wherein two ends of the LED tube respectively have two conductive pin assemblies electrically connected to the mains supply and a detecting control component in the LED tube and electrically connected to the electrical ballast; wherein each of the conductive pin assemblies comprises two pins; wherein the detecting control component further comprises a voltage conversion device, a recognizable electrical ballast, a voltage impedance signal-recognizing device, a direct current filtering module, and a buck-boost constant current module, the voltage impedance signal-recognizing device comprises a signal receiving module and a signal executing module; the voltage conversion device is electrically connected to the electrical ballast or the mains supply to perform an alternate current-direct current voltage conversion, the recognizable electrical ballast is electrically connected to the voltage conversion device to detect a voltage state of the voltage conversion device to recognize a voltage impedance complying with the electrical ballast or the mains supply, so that the recognizable electrical ballast generates a feedback signal; the signal receiving module of the voltage impedance signal-recognizing device obtains the feedback signal, and the signal executing module automatically encloses to form a loop, thereby generating a direct current starting voltage complying with the electrical ballast or the mains supply, wherein the direct current starting voltage is filtered by the direct current filtering module, and an outputted current magnitude of the direct current starting voltage is adjusted by the buck-boost constant current module.

2. The LED tube according to claim 1, wherein the electrical ballast is further electrically connected to a first buck circuit module and a second buck circuit module.

3. The LED tube according to claim 2, wherein the first buck circuit module is formed by a plurality of capacitors.

4. The LED tube according to claim 2, wherein the second buck circuit module comprises at least one varistor or at least one transient suppression diode.

5. The LED tube according to claim 1, wherein the voltage conversion device is a bridge rectifier.

6. The LED tube according to claim 1, wherein each of the conductive pin assemblies is connected to a fuse.

7. The LED tube according to claim 6, wherein the fuse is a current-limiting fuse, a temperature-limiting fuse, or a self-recoverable fuse.

8. The LED tube according to claim 1, further comprising a base and a lampshade, wherein the base is provided for assembling with the conductive pin assemblies, the detecting control component, and an LED component; and the lampshade is assembled on the base and shields the LED component.

* * * * *